US010457508B2

(12) United States Patent
Takanaga et al.

(10) Patent No.: US 10,457,508 B2
(45) Date of Patent: Oct. 29, 2019

(54) SHEET MATERIALS SEPARATION-AIDING APPARATUS

(71) Applicant: OYABE SEIKI CO., LTD, Toyama (JP)

(72) Inventors: Masashi Takanaga, Toyama (JP); Masahiro Habashima, Toyama (JP); Hironobu Suna, Toyama (JP)

(73) Assignee: OYABE SEIKI CO., LTD, Toyama (JP)

( * ) Notice: Subject to any disclaimer, the term of this patent is extended or adjusted under 35 U.S.C. 154(b) by 0 days.

(21) Appl. No.: 15/716,567

(22) Filed: Sep. 27, 2017

(65) Prior Publication Data

US 2018/0215562 A1 Aug. 2, 2018

(30) Foreign Application Priority Data

Jan. 30, 2017 (JP) ..... 2017-13831

(51) Int. Cl.
*B65H 3/24* (2006.01)
*B21D 43/24* (2006.01)
*B65H 3/02* (2006.01)

(52) U.S. Cl.
CPC ..... *B65H 3/242* (2013.01); *B21D 43/24* (2013.01); *B65H 3/02* (2013.01); *B65H 2301/4421* (2013.01)

(58) Field of Classification Search
CPC .. B65H 3/242; B65H 3/02; B65H 2301/4421; B21D 43/24; B21D 43/02
(Continued)

(56) References Cited

U.S. PATENT DOCUMENTS 2,847,212 A * 8/1958 Stem ..... B21D 43/24 271/18.1
3,339,915 A * 9/1967 Ricard ..... B21D 43/18 271/18.2

(Continued)

FOREIGN PATENT DOCUMENTS

CN 104583101 A 4/2015
CN 106032215 A 10/2016

(Continued)

*Primary Examiner* — Lynn E Schwenning
(74) *Attorney, Agent, or Firm* — King & Schickli, PLLC

(57) ABSTRACT

A main object of the invention is to provide a sheet material separation-aiding apparatus that ensures that there can be a gap produced stably between a specific sheet material from a stack of sheet materials and a sheet material just below it, and that achieves size reductions, reduced energy consumptions and a decreased parts count. As shown in FIG. 4, the sheet material separation-aiding apparatus 1 comprises a rotating means 2 including an abutment portion 21 that is capable of coming in abutment on an end of the uppermost sheet material 101, a supporting means 3 that supports the rotating means 2 in a rotatable manner and is capable of moving in a vertical direction, a biasing means 4 that biases the supporting means 3 in a downward direction, and a lifting means 5 that lifts up an end 23 of the rotating means 2 in opposition to the abutment portion 21. As the end 23 is lifted up, it causes the rotating means 2 to rotate with the abutment portion 21 coming in abutment on the end of the sheet material 101, and as the end 23 is further lifted up, it causes the supporting means 3 and rotating means 2 to keep on going up while the rotating means 2 is kept from rotation by a counterforce that the abutment portion 21 receives from the sheet material 101.

13 Claims, 4 Drawing Sheets

(58) Field of Classification Search
USPC ..... 414/795.4, 796.5, 796.6, 797.1
See application file for complete search history.

(56) References Cited

U.S. PATENT DOCUMENTS

| | | | | |
|---|---|---|---|---|
| 3,809,388 | A * | 5/1974 | Downing | B65G 57/005<br>271/20 |
| 5,611,658 | A * | 3/1997 | Olofsson | B65H 3/28<br>414/797.3 |
| 2015/0202654 | A1* | 7/2015 | Kitagawa | B65H 1/14<br>427/207.1 |

FOREIGN PATENT DOCUMENTS

| | | | |
|---|---|---|---|
| DE | 69322507 | T2 | 5/1999 |
| JP | S5074080 | | 11/1948 |
| JP | S5117985 | | 7/1949 |
| JP | S51068177 | | 6/1976 |
| JP | 2001205373 | | 7/2001 |
| WO | WO2008039129 | | 4/2008 |

* cited by examiner

SHEET MATERIALS SEPARATION-AIDING APPARATUS

TECHNICAL FIELD

The present invention relates to a sheet material separation-aiding apparatus that is incorporated in a sheet material separator of a material feeder system capable of supplying a sheet material from stacked sheet materials on a one-by-one basis to the next step for the purpose of creating or making a gap between a specific sheet material in that stack and a sheet material positioned just below it thereby ensuring that the sheet materials to be delivered are separated off on the one-by-one basis.

BACKGROUND OF THE INVENTION

As a plurality of sheet materials are supplied by the material feeder system to processing equipment in the next step for sheet material processing, it often gives rise to a breakdown of the processing equipment.

In order to prevent such a breakdown of the processing equipment, the material feeder system must feed sheet materials to the next step on a one-by-one basis.

For the material feeder system, therefore, it is required to ensure that one sheet material is separated off from a stack of sheet materials.

Japanese Utility Model Application Publication No. 51-068177 discloses an apparatus for producing a gap partly between a specific sheet material and a sheet material positioned just below it.

This sheet stripper is provided for stripping the uppermost sheet material from a stack of sheet materials comprising a pile of multiple sheet materials, and comprises a holder member having a plurality of blades extending parallel to the sides of the uppermost sheet material, a first displacement means for moving the holder member away from the sides of the sheet material and a second displacement means for moving the holder member in a direction perpendicular to the plane of the sheet material.

SUMMARY OF THE INVENTION

Object of the Invention

In the aforesaid sheet material stripper, the first displacement device for moving the holder member away from the sides of the sheet material is provided separately from the second displacement device for the moving the holder member in a direction perpendicular to the plane of the sheet material.

A problem with the aforesaid sheet material stripper is thus that it is difficult to reduce its size while keeping sufficient stripping capability.

Another problem is that there are a lot of energy consumptions and a good deal of loads to the environment due to the presence of a plurality of displacement devices.

Yet another problem is that there are a large parts count and troublesome maintenance again due to the presence of a plurality of displacement devices.

The situations being like this, the present invention has for its object to provide a sheet material separation-aiding apparatus that ensures that there can be a gap created stably between a specific sheet material from a stack of sheet materials and a sheet material positioned just below it, and that achieves size reductions, reduced energy consumptions and a decreased parts count.

In order to achieve the aforesaid object, the sheet material separation-aiding apparatus of the first aspect is used in combination with a sheet material separator for separating a specific sheet material from a stack of sheet materials, and comprises:

- a rotating means including an abutment portion that is capable of coming in abutment on an end of said specific sheet material,
- a supporting means that supports said rotating means in a rotatable manner and is capable of moving in a vertical direction,
- a biasing/energizing means that biases said supporting means in a downward direction, and
- a lifting means that lifts up an end of said rotating means in opposition to said abutment portion,
- wherein said sheet material separation-aiding apparatus comprises, in order from said stack of sheet materials, said abutment portion, the center of rotation of said rotating means and the end of said rotating means in opposition to the abutment portion,
- when the end of said rotating means in opposition to the abutment portion is lifted up, said rotating means rotates with said abutment portion coming in abutment on the end of said specific sheet material, and
- when the end of said rotating means in opposition to the abutment portion is further lifted up, said supporting means and said rotating means keep on going up while said rotating means is kept from rotation by a counter-force that said abutment portion receives from said specific sheet material, whereby there is a gap taking place between said specific sheet material in said stack of sheet materials and a sheet material just below it.

With the sheet material separation-aiding apparatus of the first aspect, it is possible to make use of only the operation of the lifting means thereby making a gap between said specific sheet material in the stacked sheet materials and a sheet material positioned just below it.

In the sheet material separation-aiding apparatus of the second aspect, based on the aforesaid apparatus, said rotating means, said supporting means, said biasing means and said lifting means in the sheet material separation-aiding apparatus are integrated together in such a way as to be capable of turning about the axis of turning parallel to the stacking direction of said stacked sheet materials.

In some cases, the stacked sheet materials are poor in positioning accuracy; so a side defining an end of a specific sheet material is obliquely placed with respect to the sheet material separation-aiding apparatus. Even with the specific sheet material tilting down, the sheet material separation-aiding apparatus of the second aspect has in addition to the feature of the apparatus of the first aspect another feature that the abutment portion is capable of coming in abutment on the obliquely placed side at right angles.

In the sheet material separation-aiding apparatus of the third aspect, based on any of the aforesaid apparatuses, the aforesaid lifting means includes a cylinder, the aforesaid supporting means can be guided by a vertically provided guide rod member in a vertical direction, there is a cylinder hanger provided that extends from an upper end of the aforesaid guide rod member in a direction away from the aforesaid stacked sheet materials, and the aforesaid cylinder includes a main body hanged down from the aforesaid cylinder hanger, and a distal end of a cylinder rod is attached to the end of the aforesaid rotating means in opposition to said abutment portion.

In addition to the feature of the apparatus of the first or second aspect, the sheet material separation-aiding apparatus of the third aspect has another feature of contracting the cylinder thereby lifting up the end of the rotating means in opposition to the abutment portion.

In addition to the feature of the apparatus of the first or second aspect, the sheet material separation-aiding apparatus of the third aspect has yet another feature of mounting the cylinder in place while put in an oblique state as viewed for sideways. For this reason, the vertical height and left-and-right depth dimension of the apparatus as viewed from sideways can be made short.

In the sheet material separation-aiding apparatus of the forth aspect, based on the aforesaid apparatus, the aforesaid biasing means is a coil spring through which the aforesaid rod member passes.

In addition to the feature of the apparatus of the third aspect, the sheet material separation-aiding apparatus of the forth aspect has another feature of extending or contracting the axis of the coil spring substantially in alignment with the axis of the guide rod member, because the guide rod member passes through the coil spring that is the biasing means so that the supporting means can be biased by the biasing means or coil spring in a certain position and in a certain direction. Thus, the sheet material separating-aiding apparatus makes sure repetition of operation capable of creating a gap between stacked sheet materials and a specific sheet material.

The sheet material separation-aiding apparatus of the fifth aspect, based on any of the aforesaid apparatuses further includes a magnet floater, and there is a vertically extending slit provided on the surface of the magnet floater in opposition to the stacked sheet materials, wherein the aforesaid rotating means rotates so that the aforesaid abutment portion pops out of the aforesaid slit/slot to come in abutment on the end of the aforesaid specific sheet material.

In addition to the feature of any one of the aforesaid apparatus, the sheet material separation-aiding apparatus of the fifth aspect has another feature of incorporating a mechanism in the magnet floater in which mechanism there is a gap created between a specific sheet material in the stacked sheet materials and a sheet material positioned just below it only by the operation of the lifting means Thus, the sheet material separation-aiding apparatus may be hybridized in such a way as to be well compatible with both a ferrous sheet material and a nonferrous sheet material like an aluminum sheet material. The sheet material separation-aiding apparatus that is compatible with both a ferrous sheet material and a nonferrous sheet material like an aluminum sheet material may also be repurposed for use with existing equipment, to which a magnet floater is compatible with an iron sheet material alone, without making any considerable modification to it.

With the sheet material separation-aiding apparatus according to the invention recited in any one of the aforesaid aspects, it is possible to create a gap between stacked sheet materials and a specific sheet material in a stable manner and achieve size reductions, energy savings and a parts count reduction.

MODES FOR CARRYING OUT THE INVENTION

Reference is now made to a stack of sheet materials 100 used in combination with a sheet material separator including a sheet material separation-aiding apparatus 1 according to one embodiment of the invention.

Figure 2:
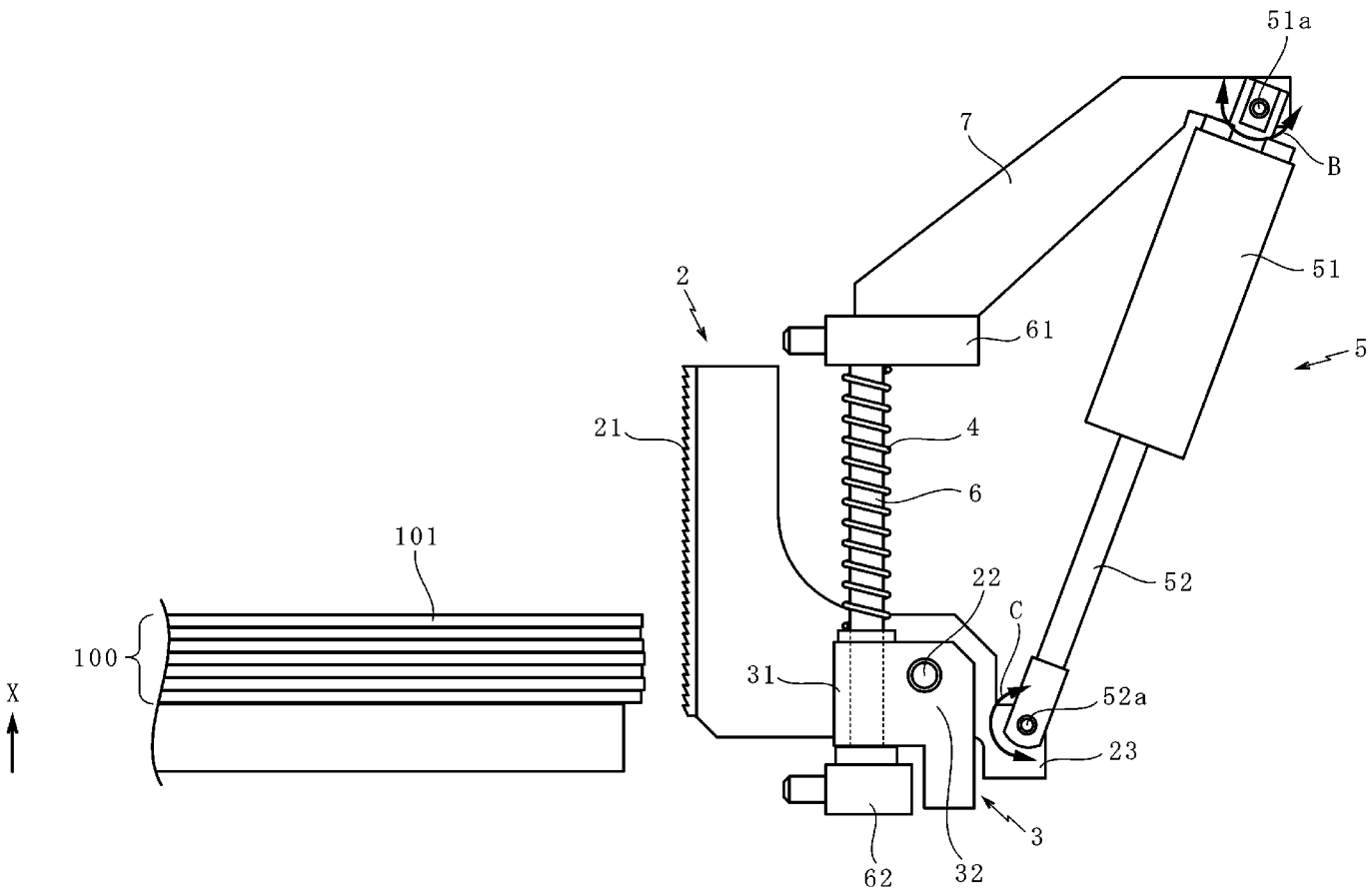
FIG. 2 is a side view of the rotating means, supporting means, biasing means and lifting means in the sheet material separation-aiding apparatus of FIG. 1 in a state before an abutment comes in abutment on a specific sheet material.
Figure 3:
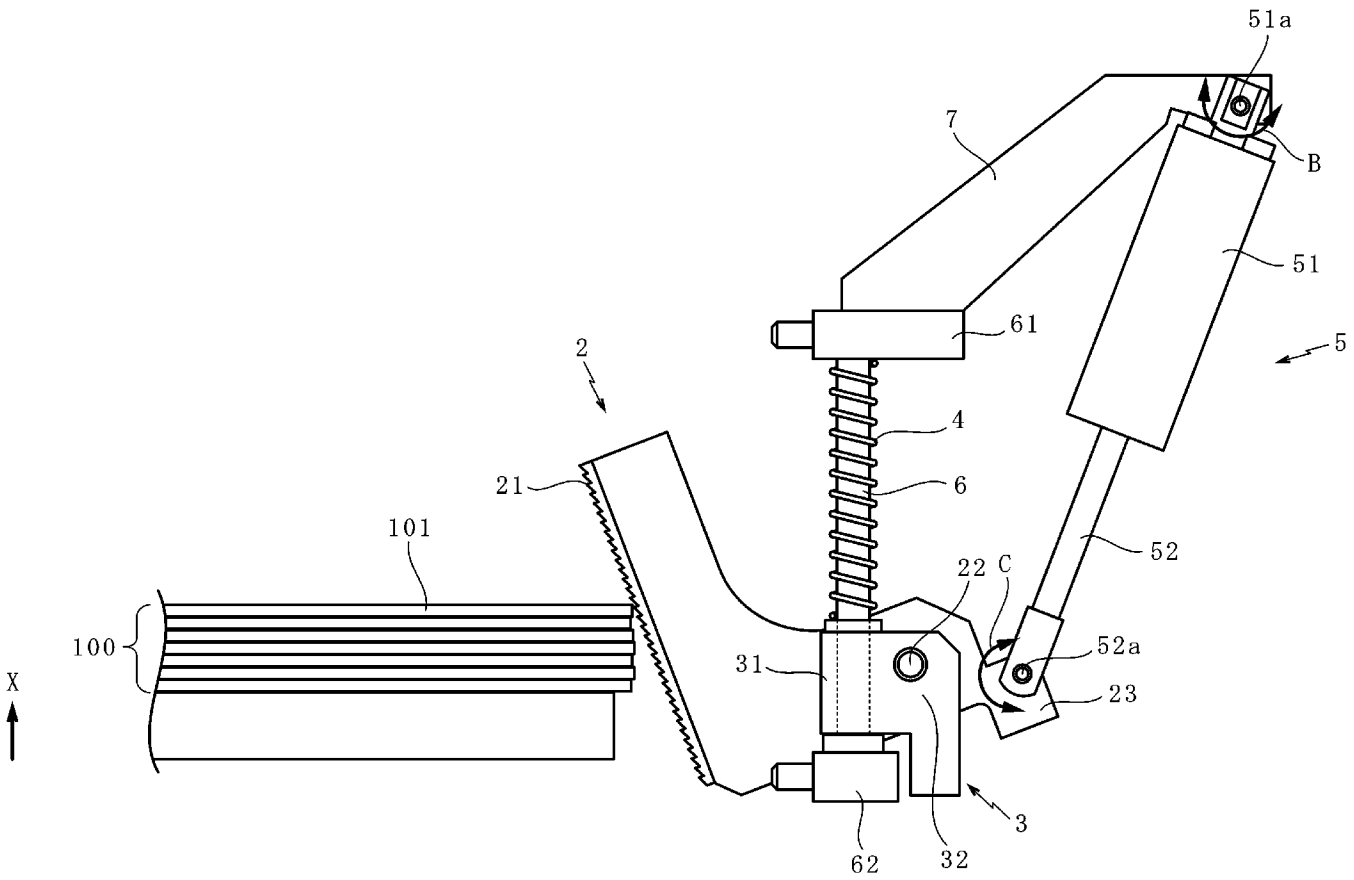
FIG. 3 is a side view of the rotating means, supporting means, biasing means and lifting means in the sheet material separation-aiding apparatus of FIG. 1 in a state where the abutment comes in abutment on the specific sheet material.
Figure 4:
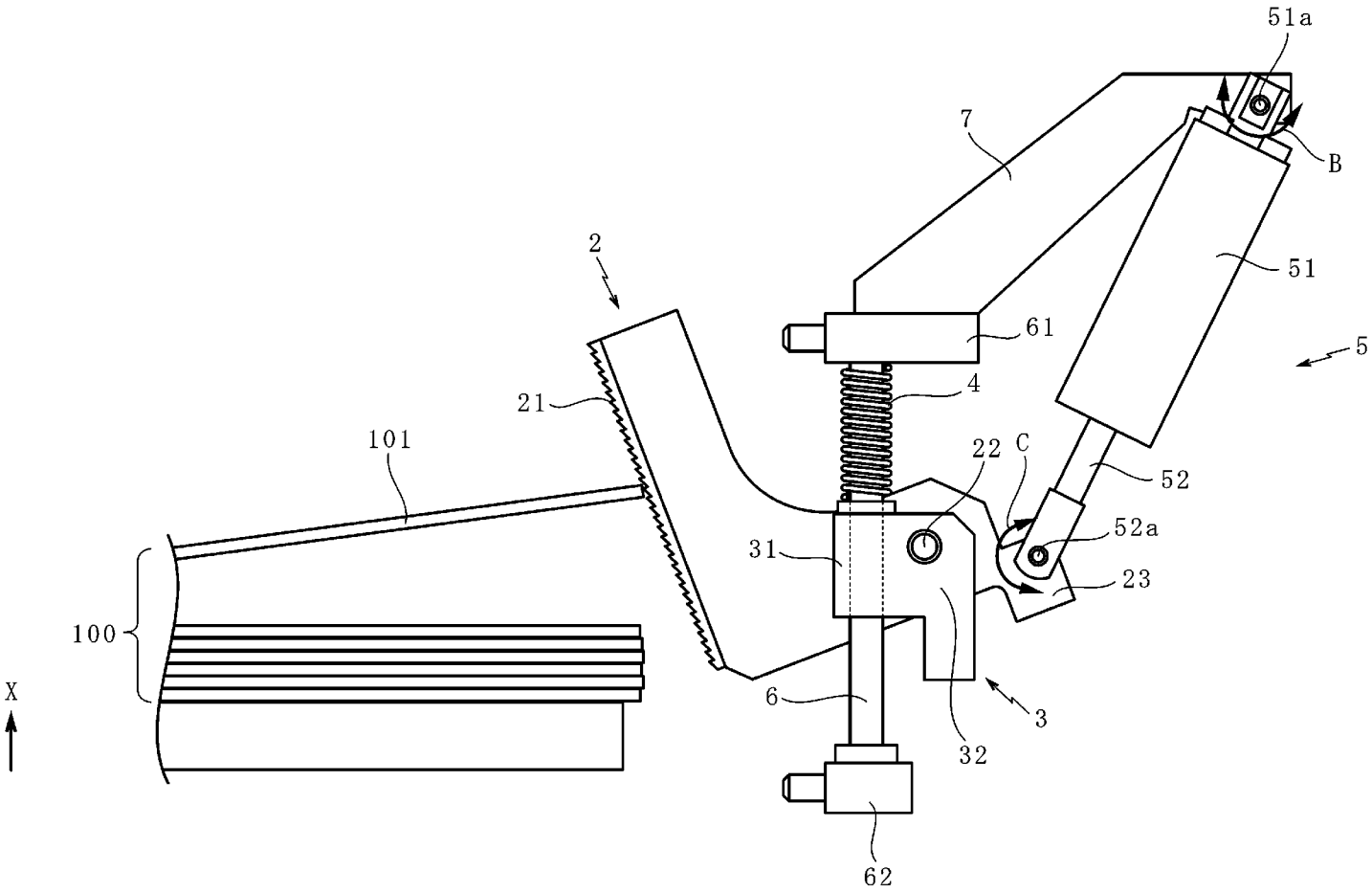
FIG. 4 is a side view of the rotating means, supporting means, biasing means and lifting means in the sheet material separation-aiding apparatus of FIG. 1 in a state where the specific sheet material is raised or lifted up.

The sheet materials 100 stacked up, shown in FIGS. 2, 3 and 4, are often formed of a metal such as aluminum and iron. The stack of sheet materials 100 takes on a rectangular shape as viewed from above. The X-axis direction of the coordinate axes in FIGS. 2 to 4 defines a stacking direction.

The sheet material separation-aiding apparatus 1 is provided to the sheet material separator of the material feeder that feeds a sheet material from the stack of sheet material to the next step on a one-by-one basis.

The sheet material separation-aiding apparatus 1 creates or makes a gap between the uppermost sheet material 101 that is a specific sheet material in the stack of sheet materials 100 and a sheet material positioned just below it. Then, the sheet material separator uses magnet adsorption, vacuum adsorption or the like to lift up the uppermost sheet material 101 so that only the uppermost sheet material 101 can be separated off.

As depicted in FIGS. 2 to 4, the sheet material separation-aiding apparatus 1 comprises a rotating means 2 including an abutment portion 21 capable of coming in abutment on an end of the uppermost sheet material 101, a supporting means 3 that supports the rotating means 2 in a rotatable fashion and is capable of moving in a vertical direction, a biasing means 4 for biasing the supporting means 3 in a downward direction, and a lifting means 5 for lifting up an end 23 of the rotating means 2 in opposition to the abutment portion 21.

The rotating means 2 is a plate member that is substantially L shaped as viewed from sideways.

The abutment portion 21 is provided to a portion of the rotating means 2 that tilts down toward the end of the uppermost sheet material 101 as it rotates.

The abutment portion 21 has a saw blade shape. The abutment portion 21 is designed such that when it tilts down toward, and comes into abutment on, the end of the uppermost sheet material 101, it comes into reliable engagement with the end of the uppermost sheet material 101.

The supporting means 3 is designed in such a way as to be vertically guided by a vertically provided guide rod member 6.

The supporting means 3 comprises a cylindrical portion 31 through which the guide rod member 6 passes, and a rotation-supporting portion 32 extending away from the stack 100 of sheet materials.

As depicted in FIGS. 2 to 4, the guide rod member 6 is vertically provided in such a way as to guide the cylindrical portion 31 in the vertical direction.

The rotation-supporting portion 32 supports the rotating means 2 in such a way as to be rotatable about the center 22 of rotation.

The guide rod member 6 is provided with an upper stopper 61 at its upper end and a lower stopper 62 at its lower end.

The upper 61 and lower stopper 62 prevent the supporting means 3 through which the guide rod member 6 passes and the biasing means 4 from disengagement out of the guide rod member 6. In particular, the upper 61 and lower stopper 62 limit the range of vertical movement of the supporting means 3.

The biasing means 4 comprises a coil spring through which the guide rod member 6 passes, and which comes in abutment on the upper stopper 61 at its upper end and comes in abutment on the cylindrical portion 31 of the supporting means 3 at its lower end. The biasing means 4 or coil spring biases the supporting means 3 from the upper end toward the lower end of the guide rod member 6.

The lifting means 5 includes a cylinder that includes a main portion 51 and a cylinder rod 52 capable of extension and contraction from that main portion 51.

There is a cylinder hanger 7 provided, extending from the upper stopper 61 at the upper end of the guide rod member 6 in such a direction as to be away from the stack 100 of sheet materials.

The main portion 51 of the cylinder is hanged down from the cylinder hanger 7 and, as depicted in FIGS. 2 to 4, the cylinder is capable of rocking in a direction indicated by an arrow B with the hanging position 51*a* of the main portion 51 as center.

Figure 1:
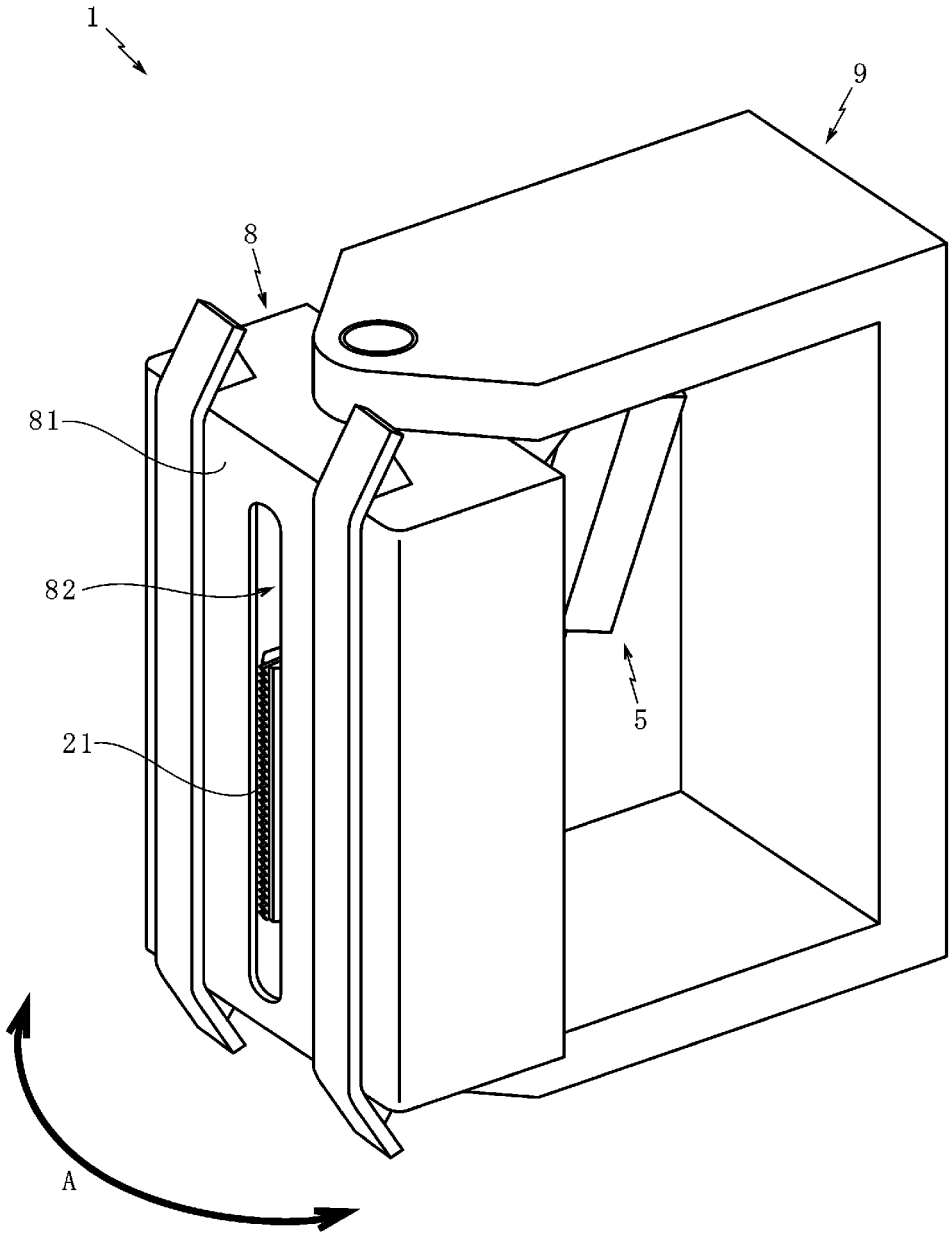
FIG. 1 is perspective view of the sheet material separation-aiding apparatus according to one embodiment of the invention.

The cylinder rod 52 is mounted at its distal end to the end 23 of the rotating means 2 in opposition to the abutment portion 21. Referring to FIGS. 1 and 2, the rotating means 2 is capable of rocking in a direction indicated by an arrow C with the mounting position 52*a* of the cylinder rod 52 as center.

As shown in FIGS. 2 to 4, the cylinder is obliquely mounted in place as viewed from sideways.

As shown in FIGS. 2 to 4, the rotating means 2 comprises, in order from the stack 100 of sheet materials, the abutment portion 21, center of rotation 22 and opposite end 23 as viewed from sideways.

The upper 61 and lower stopper 62 at the upper end of the guide rod member 6 are fixed to a magnet floater 8 that is mounted on a turning movement-supporting means 9 in such a way as to be capable of turning about the axis of turning parallel to the stacking direction of the sheet material stack 10, as indicated by an arrow A in FIG. 1.

It follows that the aforesaid rotating means 2, supporting means 3, biasing means 4, lifting means 5 and guide rod member 6 and cylinder hanger 7 and magnet floater 8 are so integrated together that they are capable of turning about the axis of turning parallel to the stacking direction of the sheet material stack 100.

The magnet floater 8 is provided on its surface 81 opposite to the sheet materials stack 100 with a vertically extending slit 82. Rotation of the rotating means 2 causes the abutment portion 21 to pop out of the slit 82, coming in abutment on the end of the uppermost sheet material 101.

When the stacked sheet materials 100 are formed of iron as an example, the sheet material separation-aiding apparatus 1 puts the magnet floater 8 in actuation to lift up the uppermost sheet material 101. For instance, when the stacked sheet materials 100 are formed of aluminum that cannot be lifted up by the magnet floater, the uppermost sheet material 101 is lifted up by the operation to be described below. Thus, the sheet material separation-aiding apparatus 1 is well compatible with both sheet materials, one being formed of iron and another of a nonferrous metal such as aluminum.

FIG. 2 shows a state of the sheet material separation-aiding apparatus 1 before it comes in abutment on the end of the sheet material stack 100. The supporting means 3 is in abutment on the lower stopper 62 by biasing of the biasing means 4. The end of the cylinder rod 52 is in a position away from the main portion 51, and the abutment portion 21 of the rotating means 2 is standing up as viewed from sideways.

As the cylinder of the lifting means 5 contracts from the state of FIG. 2, there is a force produced for lifting up the opposite end 23 of the rotating means 2. The lifting force of the lift means 5 causes the rotating means 2 to rotate counterclockwise in FIGS. 2 to 4 about the center of rotation 22.

At that time, the center of rotation 22 acts as the fulcrum and the mounting position 52*a* of the cylinder rod 52 acts as the point of effort. Rotation of the rotating means 2 causes the abutment portion 21 to tilt down toward the end of the uppermost sheet material 101.

As shown in FIG. 3, the abutment portion 21 comes in abutment on the end of the uppermost sheet material 101, whereupon the rotation of the rotating means 2 remains a halt by a counterforce that the abutment portion 21 receives from the uppermost sheet material 101.

The cylinder of the lifting means 5 contracts further from a state of FIG. 3. At this time, the point of the abutment portion 21 in abutment on the end of the uppermost sheet material 101 acts as the fulcrum, the mounting position 52*a* of the cylinder rod 52 as the point of effort, and the center of rotation 22 as the point of action.

Upward lifting force takes place at the center of rotation 22 of the rotating means 2, so does at the supporting means 3 that supports the rotating means 2.

This upward lifting force allows the supporting means 3 and rotating means 2 to go up against the biasing action of the biasing means 4.

The counterforce received by the abutment portion 21 allows the supporting means 3 and rotating means 2 to start going up; there is no need for controlling the actuation of the cylinder of the lifting means 5 or the like.

As the supporting means 3 and rotating means 2 start going up, it causes the end 23 of the rotating means 2 in opposition to the abutment portion 21 to be lifted up. At this time, the biasing means 4 is actuated such that the center of rotation 22 of the rotating means 2 is pushed down by way of the supporting means 3.

Consequently, there is a moment taking place in such a direction as to press the abutment portion 21 constantly against the end of the uppermost sheet material 101. Thus, the support means 3 and rotating means 2 keep on going up, as shown in FIG. 4, without moving the abutment portion 21 away from the uppermost sheet 101.

The aforesaid operation allows the sheet material separation-aiding apparatus 1 to lift up the uppermost sheet material 101, making a gap between the uppermost sheet material 101 and a sheet material positioned just below it.

The uppermost sheet material 101 is further lifted up by means of magnet adsorption, vacuum adsorption or the like. Once only the uppermost sheet material 101 has been separated off, the cylinder of the lifting means 5 extends.

This extension of the cylinder causes the supporting means 3 and rotating means 2 to go down. As the cylinder of the lifting means 5 extends further after abutment of the supporting member 3 on the lower stopper 62, it causes the rotating means 2 to rotate clockwise in FIGS. 2 to 4 about the center of rotation 22.

This rotation of the rotating means 2 causes the abutment portion 21 to return from the state in which it tilts down back to such a state shown in FIG. 2 in which it stands up.

By repetition of the aforesaid operation of the sheet material separation-aiding apparatus 1, a gap can be sequentially made between the stacked sheet material 100 and the uppermost sheet material 101.

In the aforesaid embodiment, the stacked sheet materials 100 have been explained with reference to aluminum, iron or other metal sheets, but the present invention is in no sense limited to it. Nonmetal sheet materials may also be used for the stacked sheet materials.

In the aforesaid embodiment, the rotating means 2 has been explained with reference to the plate member that is substantially L-shaped as viewed from sideways, but the present invention is in no sense limited to it. The rotating means may have other configurations provided that it comprises, in order from the stacked sheet materials, the abutment portion, the center of rotation of the rotating means and the end of the rotating means in opposition to the abutment portion.

In the aforesaid embodiment, the abutment portion 21 has been explained with reference to the one having a saw blade shape, but the present invention is in no sense limited to it. The abutment portion may have a configuration such that when the supporting means and rotating means go up, there is a frictional force large enough to prevent a sheet material from dropping from between the abutment portion and the sheet material on which it abuts.

In the aforesaid embodiment, the supporting means 3 has been explained with reference to the one including the cylindrical portion 31 through which the guide rod member 6 passes and the rotation-supporting portion 32 that extends from the cylindrical portion 31 in a direction away from the stacked sheet materials, but the present invention is in no sense limited to it. The supporting means may have other configuration provided that the supporting means is vertically guided while the rotating means is supported in a rotatable manner.

In the aforesaid embodiment, the guide rod member 6 has been explained with reference to the one designed to guide the cylindrical portion 31 of the supporting means, but the present invention is in no sense limited to it. Other mechanism may also be used with the proviso that the supporting means can be vertically guided.

In the aforesaid embodiment, the biasing means 4 has been explained with reference to the one comprising a coil spring, but the present invention is in no sense limited to it. For the biasing means, other mechanical element may also be used to bias the supporting means.

In the aforesaid embodiment, the lifting means 5 has been explained with reference to the one including a cylinder, but the present invention is in no sense limited to it. Any mechanism other than the cylinder may also be used to lift up the end of the rotating means in opposition to the abutment portion.

In the aforesaid embodiment, the cylinder has been explained with reference to the one that is obliquely mounted in place as viewed from sideways, as shown in the side views of FIGS. 2 to 4, but the present invention is in no sense limited to it. The cylinder may be longitudinally or laterally mounted in place as viewed from sideways, provided that the end of the rotating means in opposition to the abutment portion can be lifted up.

In the aforesaid embodiment, the sheet material separation-aiding apparatus 1 has been explained with reference to the stacked sheet materials 100 formed of iron as an example wherein the uppermost sheet material 101 is lifted up by the magnet floater 8, but the present invention is in no sense limited to it. Even with the stacked sheet materials formed typically of iron, the uppermost sheet material may be lifted up by the magnet floater 8 once the sheet material separation-aiding apparatus has gone to the trouble of raising the uppermost sheet material in the same operation as is the case with aluminum, so as to ensure that the only uppermost sheet material is lifted up or separated off.

EXPLANATION OF THE REFERENCE NUMERALS

1: Sheet material separation-aiding apparatus
2: Rotating means
3: Supporting means
4: Biasing means
5: Lifting means
6: Guide rod member
7: Cylinder hanger
8: Magnet floater
9: Turning movement-supporting means
21: Abutment portion
22: Center of rotation
23: Opposite end
31: Cylindrical portion
32: Rotation supporting portion
51: Main portion
51*a*: Hanging position
52: Cylinder rod
52*a*: Mounting position
61: Upper stopper
62: Lower stopper
81: Surface in opposition to the stacked sheet materials
82: Slit
100: Stacked sheet materials
101: Uppermost sheet material

What is claimed is:

1. A sheet material separation-aiding apparatus used in combination with a sheet material separator for separating a specific sheet material from a stack of sheet materials, characterized by comprising;

a rotating means including an abutment portion that is capable of coming in abutment on an end of said specific sheet material, a supporting means that supports said rotating means in a rotatable manner and is capable of moving in a vertical direction, a biasing means that biases said supporting means in a downward direction, and a lifting means that lifts up an end of said rotating means in opposition to said abutment portion, wherein said sheet material separation-aiding apparatus comprises, in order from said stack of sheet materials, said abutment portion, a center of rotation of said rotating means and the end of said rotating means in opposition to the abutment portion, when the end of said rotating means in opposition to the abutment portion is lifted up, said rotating means rotates with said abutment portion coming in abutment on the end of said specific sheet material, and when the end of said rotating means in opposition to the abutment portion is further lifted up, said supporting means and said rotating means keep on going up while said rotating means is kept from rotation by a counterforce that said abutment portion receives from said specific sheet material, whereby there is a gap between said specific sheet material in said stack of sheet materials and a sheet material below it.

2. The sheet material separation-aiding apparatus according to claim 1, characterized in that said rotating means, said supporting means, said biasing means and said lifting means are configured in such a way as to be capable of turning about a parallel axis of turning to the stacking direction of said stack of sheet materials.

3. The sheet material separation-aiding apparatus according to claim 2, characterized in that:

said lifting means includes a cylinder, said supporting means can be guided by a vertically provided guide rod member in a vertical direction, a cylinder hanger extends from an upper end of said guide rod member in a direction away from said stack of sheet materials, and said cylinder includes a main portion hung from said cylinder hanger, and a distal end of a cylinder rod is attached to the end of said rotating means in opposition to said abutment portion.

4. The sheet material separation-aiding apparatus according to claim 2, characterized by further including a magnet floater, wherein:

said magnet floater is mounted on a support in opposition to said stack of sheet materials with a vertically extending slit, and said rotating means rotates so that said abutment portion pops out of said slit to come in abutment on the end of said specific sheet material.

5. The sheet material separation-aiding apparatus according to claim 3, characterized in that said biasing means is a coil spring through which said guide rod member passes.

6. The sheet material separation-aiding apparatus according to claim 3, characterized by further including a magnet floater, wherein:

said magnet floater is mounted on a support in opposition to said stack of sheet materials with a vertically extending slit, and said rotating means rotates so that said abutment portion pops out of said slit to come in abutment on the end of said specific sheet material.

7. The sheet material separation-aiding apparatus according to claim 5, characterized by further including a magnet floater, wherein:

said magnet floater is mounted on a support in opposition to said stack of sheet materials with a vertically extending slit, and said rotating means rotates so that said abutment portion pops out of said slit to come in abutment on the end of said specific sheet material.

8. The sheet material separation-aiding apparatus according to claim 1, characterized in that:

said lifting means includes a cylinder, said supporting means can be guided by a vertically provided guide rod member in a vertical direction, a cylinder hanger extends from an upper end of said guide rod member in a direction away from said stack of sheet materials, and said cylinder includes a main portion hung from said cylinder hanger, and a distal end of a cylinder rod is attached to the end of said rotating means in opposition to said abutment portion.

9. The sheet material separation-aiding apparatus according to claim 8, characterized in that said biasing means is a coil spring through which said guide rod member passes.

10. The sheet material separation-aiding apparatus according to claim 8, characterized by further including a magnet floater, wherein:

said magnet floater is mounted on a support in opposition to said stack of sheet materials with a vertically extending slit, and said rotating means rotates so that said abutment portion pops out of said slit to come in abutment on the end of said specific sheet material.

11. The sheet material separation-aiding apparatus according to claim 9, characterized by further including a magnet floater, wherein:

said magnet floater is mounted on a support in opposition to said stack of sheet materials with a vertically extending slit, and said rotating means rotates so that said abutment portion pops out of said slit to come in abutment on the end of said specific sheet material.

12. The sheet material separation-aiding apparatus according to claim 1, characterized by further including a magnet floater, wherein:

said magnet floater is mounted on a support in opposition to said stack of sheet materials with a vertically extending slit, and said rotating means rotates so that said abutment portion pops out of said slit to come in abutment on the end of said specific sheet material.

13. The sheet material separation-aiding apparatus of claim 1, wherein the rotating means is enabled to rotate, thereby causing the abutment portion to tilt down toward the edge of the uppermost sheet material.

* * * * *